US008138949B2

(12) United States Patent
Tsuzuki et al.

(10) Patent No.: US 8,138,949 B2
(45) Date of Patent: Mar. 20, 2012

(54) ELECTRONIC TOLL COLLECTION SYSTEM, ON-BOARD UNIT, AND TERMINAL UNIT

(75) Inventors: Fumito Tsuzuki, Toyota (JP); Osamu Eguchi, Kuwana (JP); Yoshihide Kayo, Hekinan (JP); Shouichirou Hanai, Anjo (JP)

(73) Assignee: Denso Corporation, Kariya (JP)

( * ) Notice: Subject to any disclaimer, the term of this patent is extended or adjusted under 35 U.S.C. 154(b) by 917 days.

(21) Appl. No.: 12/072,318

(22) Filed: Feb. 26, 2008

(65) Prior Publication Data

US 2008/0204278 A1 Aug. 28, 2008

(30) Foreign Application Priority Data

Feb. 28, 2007 (JP) ..... 2007-049555

(51) Int. Cl.
*G08G 1/065* (2006.01)

(52) U.S. Cl. ..... 340/928; 340/923; 340/933; 340/5.42; 340/5.6; 340/10.41; 340/426.16; 340/429.18; 705/13; 705/50

(58) Field of Classification Search ..... 340/928, 340/923, 933, 5.42, 5.6, 10.41, 426.16, 426.18; 705/13, 50–79; 701/1, 117, 200, 208; 455/41.2, 455/115.1; 235/375, 384, 492; 342/42
See application file for complete search history.

(56) References Cited

U.S. PATENT DOCUMENTS 4,303,904 A * 12/1981 Chasek ..... 235/384
5,760,709 A * 6/1998 Hayashi ..... 340/923
6,690,293 B2 * 2/2004 Amita ..... 340/928
6,816,707 B1 * 11/2004 Barker et al. ..... 455/41.2
7,212,989 B1 * 5/2007 Taniguchi ..... 705/13
2002/0145542 A1 * 10/2002 Yamashita ..... 340/935
2003/0105662 A1 * 6/2003 Koketsu et al. ..... 705/13
2004/0174272 A1 * 9/2004 Lin ..... 340/928

FOREIGN PATENT DOCUMENTS

JP 10-021438 1/1998
JP 11-195151 7/1999

(Continued)

OTHER PUBLICATIONS

Office action dated Feb. 3, 2009 in Japanese Application No. 2007-049555.

(Continued)

*Primary Examiner* — George Bugg
*Assistant Examiner* — Sisay Yacob
(74) *Attorney, Agent, or Firm* — Harness, Dickey & Pierce, PLC

(57) ABSTRACT

In an electronic toll collection system, card data of a payment card is stored in an on-board unit mounted in a vehicle. Toll data necessary for a toll collection transaction including the card data is copied from the on-board unit to a cellular phone. A user passes the cellular phone to a tollgate attendant, and the toll data is moved to a toll collection unit installed at a tollgate. The toll collection unit calculates a toll fee based on the toll data and generates a delete command and road use data. When the tollgate attendant passes a portable terminal of the toll collection unit to the user, the delete command and the road use data are copied to the on-board unit. The toll data is deleted from the on-board unit by the delete command, and the road use data is reported to the user.

9 Claims, 10 Drawing Sheets

FOREIGN PATENT DOCUMENTS

| | | |
|---|---|---|
| JP | 11-283063 | 10/1999 |
| JP | 2002-008076 | 1/2002 |
| JP | 2003-178344 | 6/2003 |
| JP | 2004-295549 | 10/2004 |
| JP | 2004-362174 | 12/2004 |

OTHER PUBLICATIONS

U.S. Appl. No. 11/899,357, filed Sep. 4, 2007, Eguchi et al.
Office action dated Sep. 25, 2009 in corresponding Chinese Application No. 2008 100741889.

* cited by examiner

ELECTRONIC TOLL COLLECTION SYSTEM, ON-BOARD UNIT, AND TERMINAL UNIT

CROSS REFERENCE TO RELATED APPLICATION

This application is based on and incorporates herein by reference Japanese Patent Application No. 2007-49555 filed on Feb. 28, 2007.

FIELD OF THE INVENTION

The present invention relates to an electronic toll collection system, an electronic toll collection on-board unit, and an electronic toll collection terminal unit.

BACKGROUND OF THE INVENTION

In recent years, an electronic toll collection (ETC) system has been widely used in many countries. A conventional ETC system works by insetting a contact-type integrated circuit (IC) card into an on-board unit mounted on a vehicle. The vehicle cannot pass through a tollgate of a tollroad equipped with the ETC system, if there is a poor contact between the IC card and the on-board unit, or if a driver of the vehicle forgets to insert the IC card into the on-board unit.

Japanese Patent Application No. 2006-313377 filed by the present inventors discloses a system, in which card data of an IC card is copied to an on-board unit in advance, and the copied card data is used when the vehicle passes through a tollgate. Thus, the system allows the vehicle to pass through the tollgate without the IC card so that the driver does not have to carry the IC card.

However, since an infrastructure of an ETC system has not been completed, there are manned tollgates where roadside units designed for an ETC system are not installed. At the manned tollgate, a driver of the vehicle needs to withdraw an IC card from an on-board unit and needs to pass the IC card to a tollgate attendant to pay a toll fee. Therefore, the system disclosed in Japanese Patent Application No. 2006-313377 cannot work at the manned tollgate, if the driver does not carry the IC card.

To use the system disclosed in Japanese Patent Application No. 2006-313377 at the manned tollgate, a means for transmitting the card data stored in the on-board unit to a toll collection unit installed at the manned tollgate is required. The card data can be transmitted to the toll collection unit by connecting the on-board unit and the toll connection unit with a communication cable as the means. However, various kinds of vehicles such as trucks, small cars, and motorcycles travel a tollroad, and mounting locations of the on-board units are different between the vehicles. Therefore, if the communication cable is used as the means for transmitting the card data stored in the on-board unit to the toll collection unit, it will take much time for the vehicles to pass through the manned tollgate. As a result, traffic congestion will occur at the manned tollgate.

SUMMARY OF THE INVENTION

In view of the above-described problem, it is an object of the present invention to provide an electronic toll collection system allows a vehicle to smoothly pass through a manned tollgate without a payment card.

According to an aspect of the present invention, an electronic toll collection system includes an on-board unit mountable on a vehicle, a first terminal unit, and a second terminal unit. The on-board unit includes vehicle-side first, second, and third communication circuits, a vehicle-side memory device, and a vehicle-side control circuit. The vehicle-side first communication circuit is configured to wirelessly communicate with a roadside unit. The vehicle-side second communication circuit is configured to communicate with the first terminal unit. The vehicle-side third communication circuit is configured to communicate with the second terminal unit. The vehicle-side memory device is configured to store data. The vehicle-side control circuit is configured to control the vehicle-side first, second, and third communication circuits and the vehicle-side memory device and configured to perform data processing necessary for a toll collection transaction. The first terminal unit includes first terminal-side first and second communication circuits, a first terminal-side memory device, and a first terminal-side control circuit. The first terminal-side first communication circuit is configured to communicate with the on-board unit. The first terminal-side second communication circuit is configured to communicate with the second terminal unit. The first terminal-side memory device is configured to store data. The first terminal-side control circuit is configured to control the first terminal-side first and second communication circuits and the first terminal-side memory device. The second terminal unit includes second terminal-side first and communication circuits, a second terminal-side memory device, and a second terminal-side control circuit. The second terminal-side first communication circuit is configured to communicate with the on-board unit. The second terminal-side second communication circuit is configured to communicate with the first terminal unit. The second terminal-side memory device is configured to store data. The second terminal-side control circuit is configured to control the second terminal-side first and second communication circuits and the second terminal-side memory device.

The vehicle-side control circuit receives entrance data from a roadside unit through the vehicle-side first communication circuit and causes the vehicle-side memory device to store the entrance data. The vehicle-side control circuit transmits the entrance data and card data of a payment card to the first terminal unit through the vehicle-side second communication circuit upon satisfaction of a first predetermined condition. The card data is prestored in the vehicle-side memory device. The first terminal-side control circuit receives the entrance data and the card data from the on-board unit through the first terminal-side first communication circuit and causes the first terminal-side memory device to store the entrance data and the card data The first terminal-side control circuit transmits the entrance data and the card data to the second terminal unit through the first terminal-side second communication circuit in response to a data request that is received from the second terminal unit through the first terminal-side second communication circuit. The second terminal-side control circuit receives the entrance data and the card data from the first terminal unit through the second terminal-side second communication circuit upon transmission of the data request to the first terminal unit and generates toll collection data based on the entrance data and the card data. The second terminal-side control circuit transmits the toll collection data to the on-board unit through the second terminal-side first communication circuit upon satisfaction of a second predetermined condition. The vehicle-side control circuit deletes the entrance data from the vehicle-side memory device upon receipt of the toll collection data from the second terminal unit through the vehicle-side third communication circuit.

BRIEF DESCRIPTION OF THE DRAWINGS

The above and other objectives, features and advantages of the present invention will become more apparent from the following detailed description made with check to the accompanying drawings. In the drawings.

DETAILED DESCRIPTION OF THE PREFERRED EMBODIMENT

Figure 1:
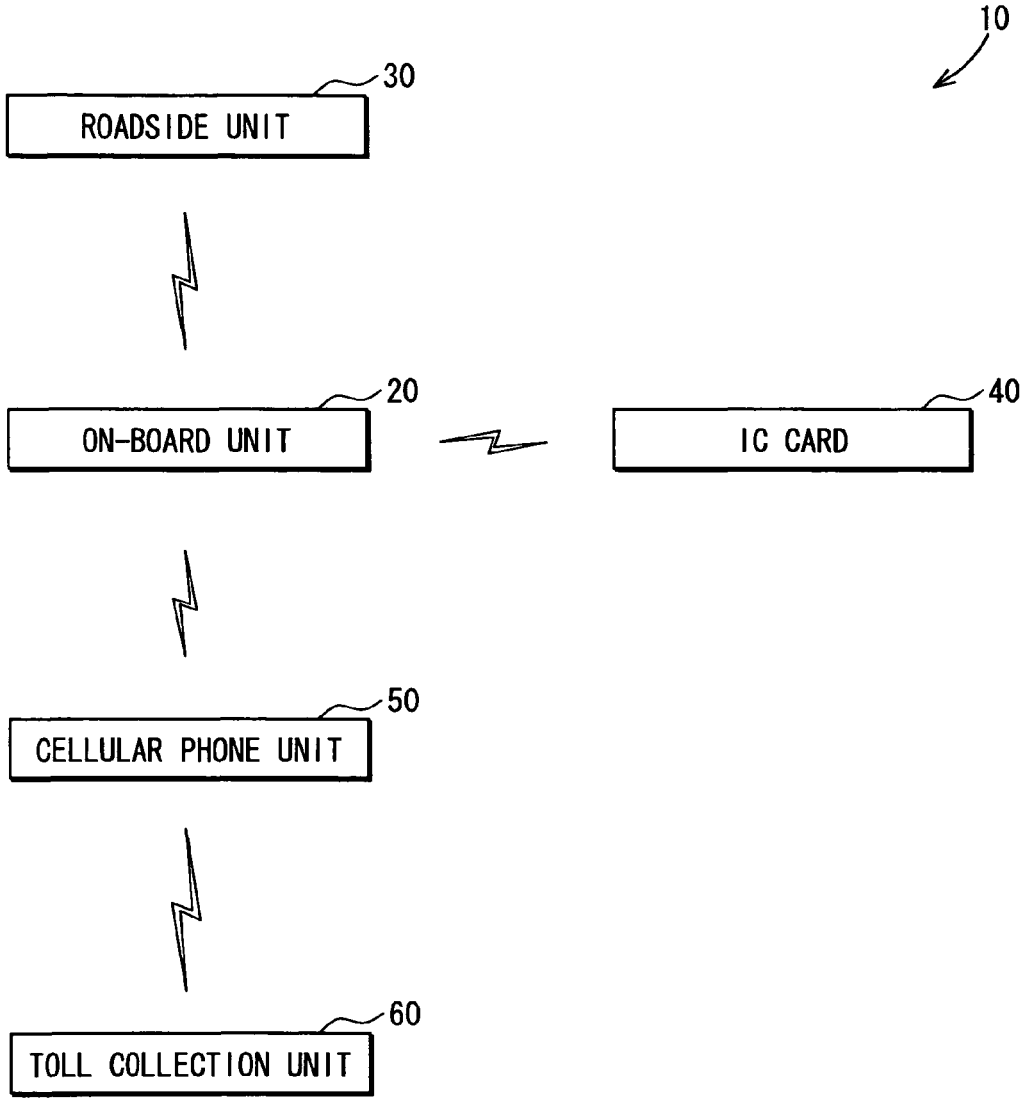
FIG. 1 is a block diagram illustrating an electronic toll collection system according to an embodiment of the present invention.

Referring to FIG. 1, an electronic toll collection (ETC) system 10 according to an embodiment of the present invention includes an on-board unit 20 mounted on a vehicle, a roadside unit 30 installed at an entrance/exit tollgate of a tollroad, an integrated circuit (IC) card 40 that stores data required for a toll collection transaction, a cellular phone unit 50 which a user (i.e., occupant of the vehicle including a driver) carries, a toll collection unit 60 installed at a manned exit tollgate of the tollroad. Although FIG. 1 shows one on-board unit 20, one roadside unit 30, one IC card 40, one cellular phone unit 50, and one toll collection unit 60, the ETC system 10 generally includes multiple sets of on-board units 20, roadside units 30, IC cards 40, cellular phone units 50, and toll collection units 60.

Figure 2A:
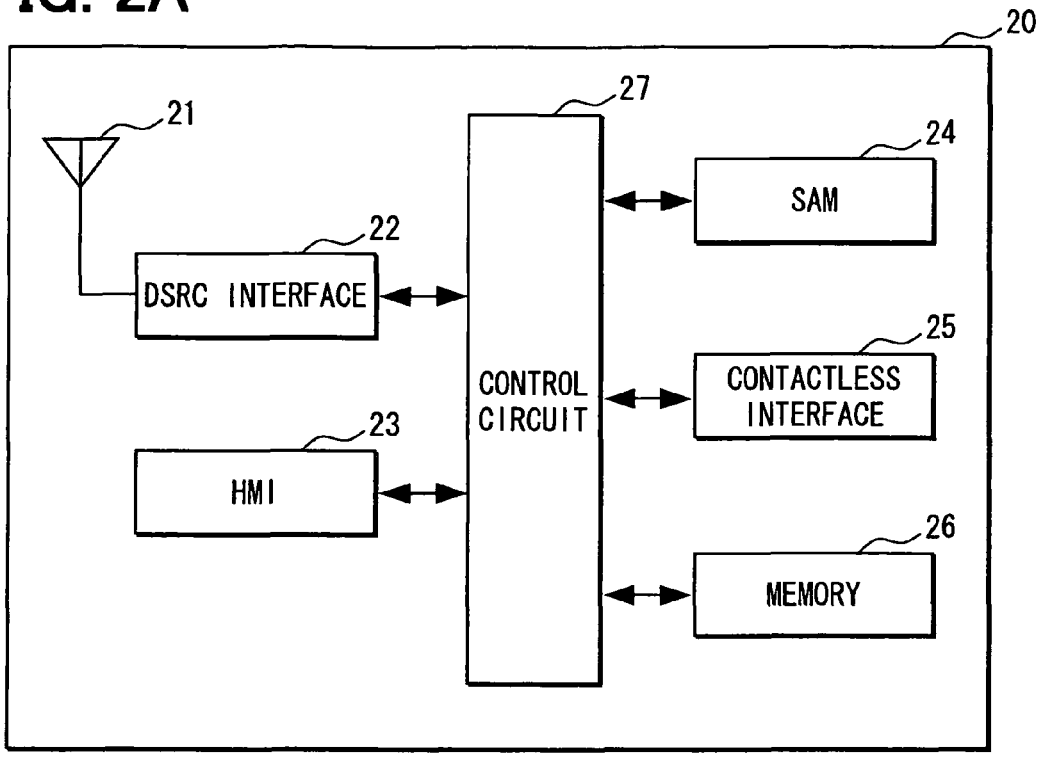
FIG. 2A is a block diagram illustrating an onboard unit for the electronic toll collection system.

As illustrated in detail in FIG. 2A, the on-board unit 20 includes a wireless antenna 21, a dedicated short range communication (DSRC) interface 22, a user machine interface (HMI) 23, a secure application module (SAM) 24, a contactless communication interface 25, a memory device 26, and a control circuit 27.

The wireless antenna 21 is a DSRC antenna. The DSRC interface 22 transmits and receives data to and from the roadside unit 30 via DSRC by using the wireless antenna 21. The HMI 23 provides an interface between the user and the on-board unit 20. For example, the HMI 23 includes an operation button, an indicator lamp such as a light-emitting diode (LED) lamp, a speaker, and/or the like. The SAM 24 encrypts and decrypts the data transmitted to and received from the roadside unit 30. Further, the SAM 24 encrypts and decrypts an unique identification (ID) code such as a control code, a registration code, a vehicle license number, and/or the like. The contactless communication interface 25 allows the on-board unit 20 to perform short range contactless wireless communication with each of the IC card 40 and the cellular phone unit 50. Alternatively, the contactless communication interface 25 can allow the on-board unit 20 to perform contact wireless communication with at least one of the IC card 40 and the cellular phone unit 50. In such a case, the at least one of the IC card 40 and the cellular phone unit 50 needs to have a contact communication interface. The memory device 26 stores various types of data and is constructed with a rewritable, nonvolatile memory device, which does not need a refresh operation to retain data. For example, the memory device 26 is constructed with a flash memory device. The control circuit 27 includes a central processing unit (CPU), a read only memory (ROM), a random access memory (RAM), and an input and output (I/O) circuit. Based on a predetermined program, the control circuit 27 controls the DSRC interface 22, the HMI 23, the SAM 24, the contactless communication interface 25, and the memory device 26.

Figure 2B:
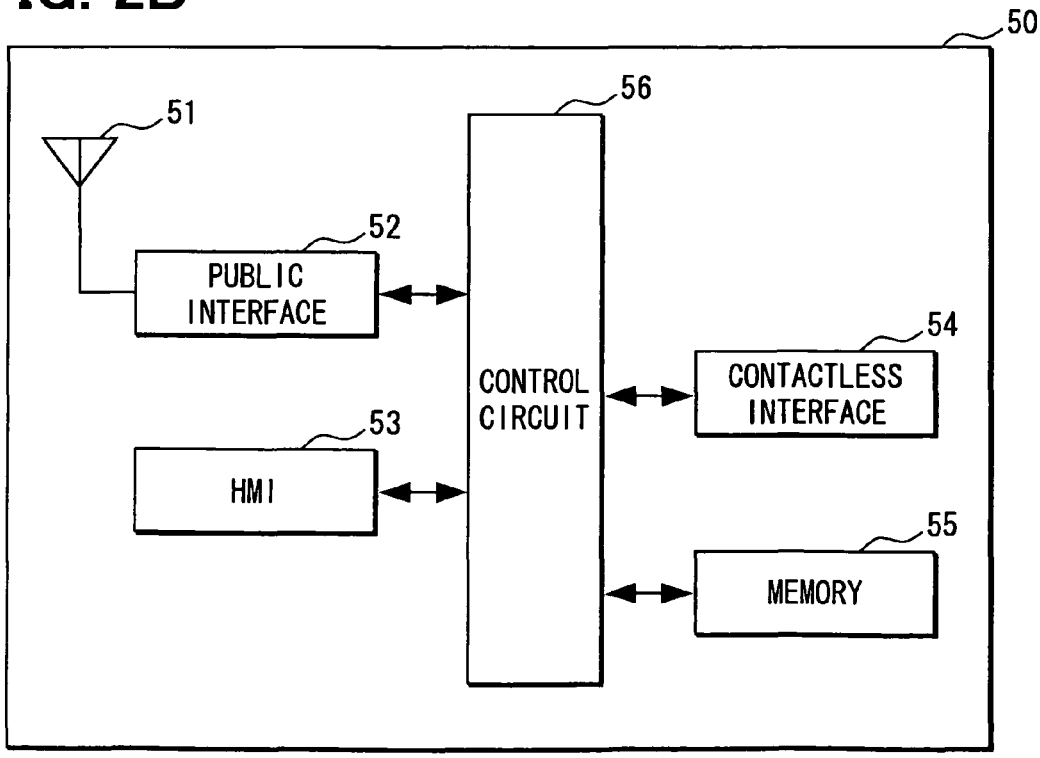
FIG. 2B is a block diagram illustrating a cellular phone unit for the electronic toll collection system.

As illustrated in detail in FIG. 2B, the cellular phone unit 50 includes a wireless antenna 51, a public communication interface 52, a HMI 53, a contactless communication interface 54, a memory device 55, and a control circuit 56.

The wireless antenna 51 allows the cellular phone unit 50 to wirelessly connect to a wireless public line network. The public communication interface 52 performs transmission and reception of data via wireless communication such as code division multiple access (CDMA) by using the wireless antenna 51. The HMI 53 provides an interface between the user and the cellular phone unit 50. For example, the HMI 53 includes an operation button, a liquid crystal display (LCD) screen, a speaker, a microphone, and/or the like. The contactless communication interface 54 allows the cellular phone unit 50 to perform short range contactless wireless communication with each of the on-board unit 20 and the toll collection unit 60. Alternatively, the contactless communication interface 54 can allow the cellular phone unit 50 to perform contact wireless communication with at least one of the on-board unit 20 and the toll collection unit 60. In such a case, the at least one of the on-board unit 20 and the toll collection unit 60 needs to have a contact communication interface. The memory device 55 stores various types of data and is constructed with a rewritable, nonvolatile memory device, which does not need a refresh operation to retain data. For example, the memory device 55 is constructed with a flash memory device. The control circuit 56 includes CPU, a ROM, a RAM, and an I/O circuit. Based on a predetermined program, the control circuit 58 controls the public communication interface 52, the HMI 53, the contactless communication interface 54, and the memory device 55.

Figure 3:
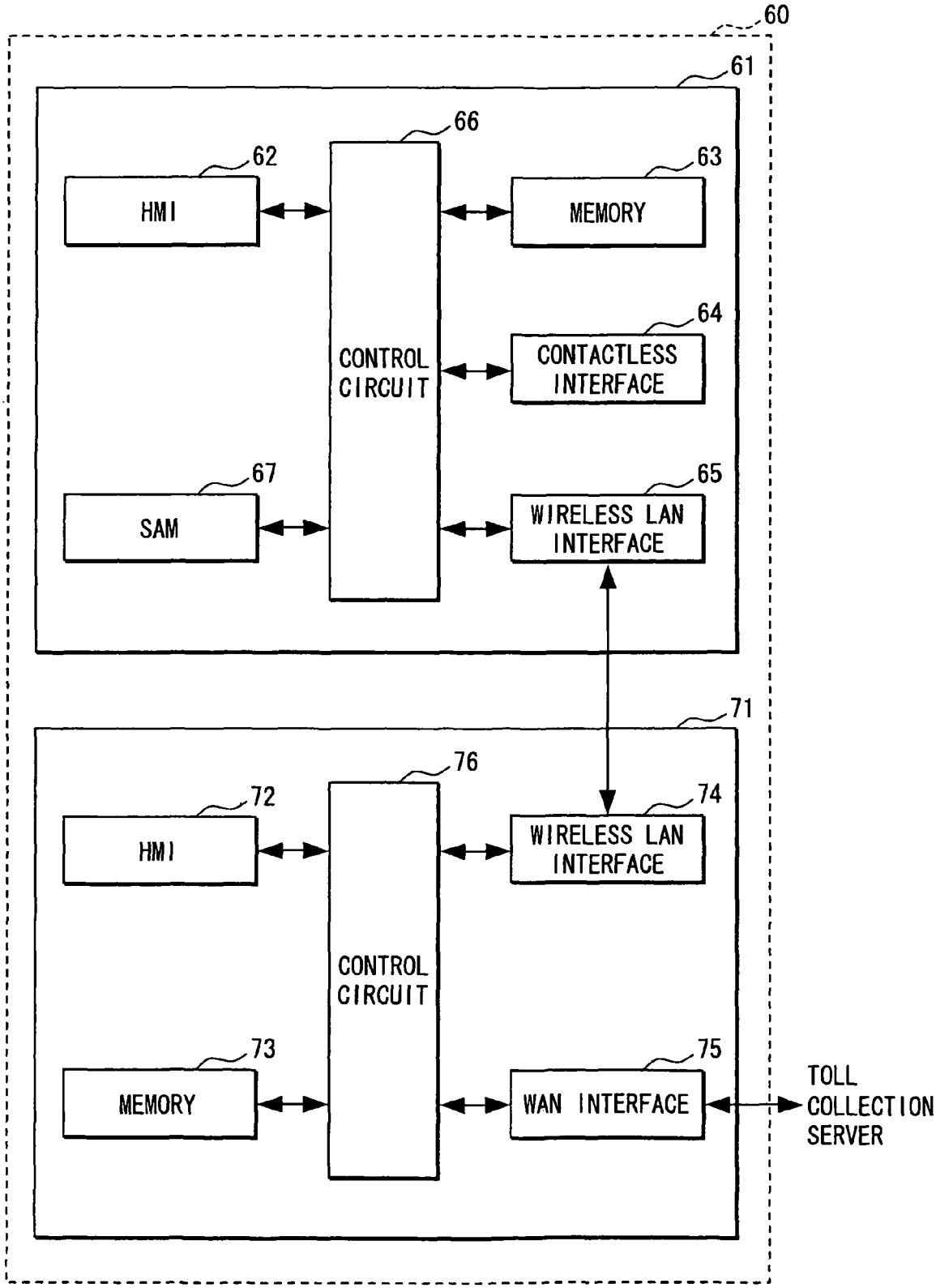
FIG. 3 is a block diagram illustrating a toll collection unit for the electronic toll collection system.

As illustrated in detail in FIG. 3, the toll collection unit 60 includes a portable terminal unit 61 and a main unit 71. The portable terminal unit 61 is a separate piece from the main unit 71 and can be used separately from the main unit 71. The portable terminal unit 61 is sized and weighted so that the user can have the portable terminal unit 61 in one hand. Unlike the portable terminal unit 61, the main unit 71 is installed and fixed in the manned exit tollgate.

The portable terminal unit 61 includes a HMI 62, a memory device 63, a contactless communication interface 64, a wireless local area network (LAN) interface 65, a control circuit 66, and a SAM 67. The HMI 62 provides an interface between the user and the portable terminal unit 61. For example, the HMI 62 includes an operation button, a LCD screen, a speaker, and/or the like. The memory device 63 stores various types of data and is constructed with a rewritable, nonvolatile memory device, which does not need a refresh operation to retain data. For example, the memory device 63 is constructed with a flash memory device. The contactless communication interface 64 allows the portable terminal unit 61 to perform short range contactless wireless communication with each of the on-board unit 20 and the cellular phone unit 50. Alternatively, the contactless communication interface 64 can allow the portable terminal unit 61 to perform contact wireless communication with at least one of the on-board unit 20 and the cellular phone unit 50. In such a case, the at least one of the on-board unit 20 and the cellular phone unit 50 needs to have a contact communication interface. The wireless LAN interface 65 allows the portable terminal unit 61 to wirelessly communicate with the main unit 71 via wireless LAN such as IEEE 802.11b. The SAM 67 encrypts and decrypts the data transmitted to and received from the main unit 71. The control circuit 66 includes a CPU, a ROM, a RAM, and an I/O circuit. Based on a predetermined program, the control circuit 66 controls the HMI 62, the memory device 63, the contactless communication interface 64, and the wireless LAN interface 65.

The main unit 71 includes a HMI 72, a memory device 73, a wireless LAN interface 74, a wide area network (WAN) interface 75, and a control circuit 76. The HMI 72 provides an interface between the user and the main unit 71. For example, the HMI 72 includes an input device such a keyboard, a LCD screen, a speaker, and/or the like. The memory device 73 stores various types of data and is constructed with a rewritable, nonvolatile memory device, which does not need a refresh operation to retain data. For example, the memory device 73 is constructed with a hard disk drive. The wireless LAN interface 74 allows the main unit 71 to wirelessly communicate with the portable terminal unit 61 via wireless LAN such as IEEE 802.11b. The WAN interface 75 allows the main unit 71 to communicate with a toll collection server (not shown) via a dedicated WAN network. The control circuit 76 includes a CPU, a ROM, a RAM, and an I/O circuit. Based on a predetermined program, the control circuit 76 controls the HMI 72, the memory device 73, the wireless LAN interface 74, and the WAN interface 75.

Figure 4:
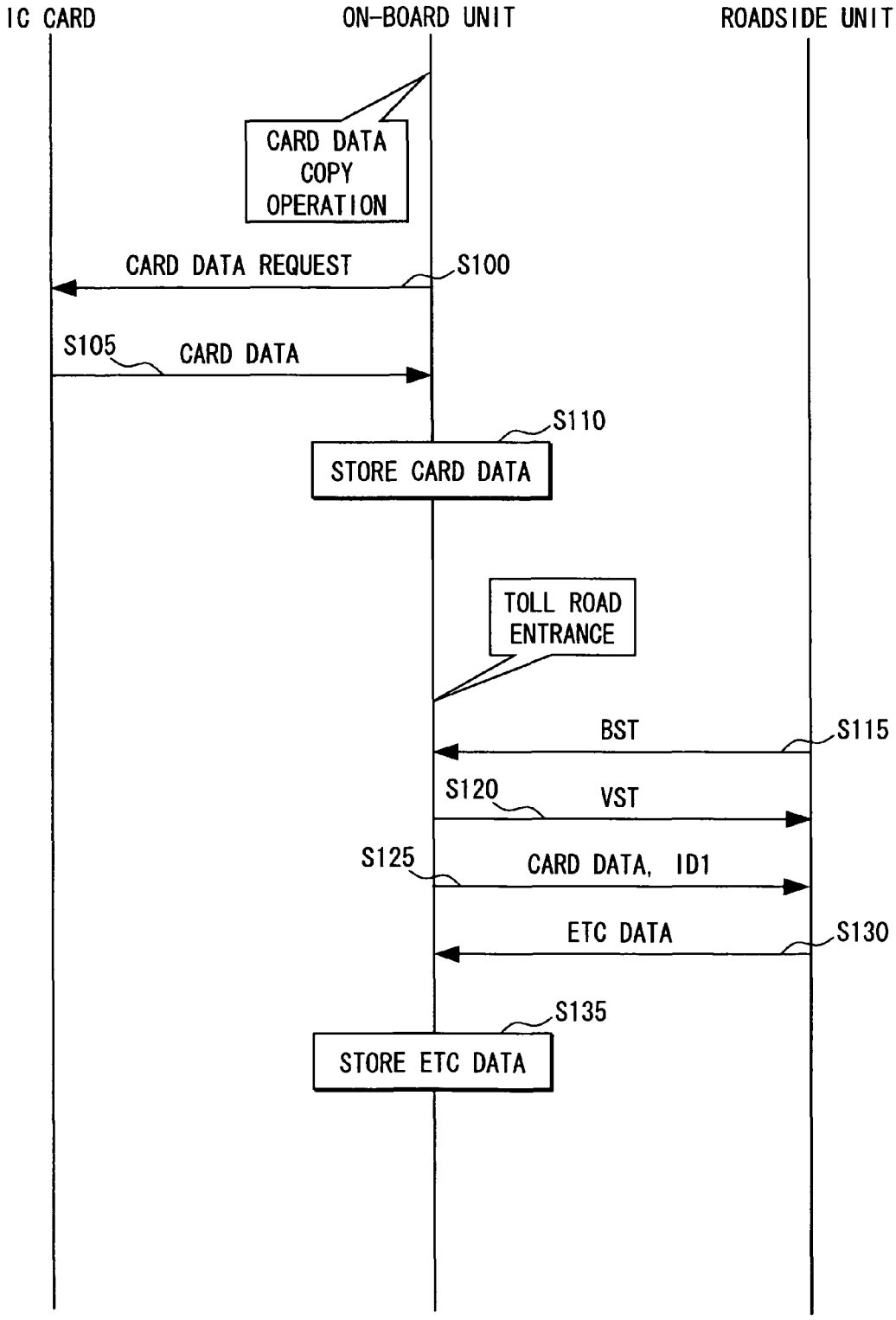
FIG. 4 is a sequence diagram illustrating a procedure for registering card data of an IC card to the on-board unit.

Operations of the ETC system 10 are described below. A copy (i.e., registration) of card data of the IC card 40 to the on-board unit 20 is preformed as shown in FIG. 4.

When a user operates the HMI 23 (specifically, a button assigned to a card data registration) of the on-board unit 20 to copy the card data of the IC card 40 to the on-board unit 20, the control circuit 27 of the on-board unit 20 sends a card data request to the IC card 40 at step S100. The card data is data necessary for a toll collection transaction for a tollroad. For example, the card data includes a card number of the IC card 40, an expiration date of the IC card 40, and a telephone number of a card company of the IC card 40. The card data is prestored in the IC card 40 in encrypted form. At step S105, the IC card 40 transmits the card data to the on-board unit 20 in response to the card data request from the on-board unit 20. At step S110, the control circuit 27 of the on-board unit 20 decrypts the card data by using the SAM 24 and causes the memory device 26 to store the card data.

When a vehicle equipped with the on-board unit 20 reaches the entrance tollgate of the tollroad, the on-board unit 20 receives a beacon service table (BST) signal from the roadside unit 30 at step S115. In response to the BST signal, the control circuit 27 of the on-board unit 20 transmits a vehicle service table (VST) signal to the roadside unit 30 at step S120. Then, the control circuit 27 encrypts the card data stored in the memory device 26 and a first unique ID code ID1 of the on-board unit 20 by using the SAM 24. The first ID code ID1 is prestored in the memory device 26. For example, the first ID code ID1 is a control number, a registration number, a vehicle license number, or the like. The control circuit 27 transmits the card data and the first ID code ID1 to the roadside unit 30 through the DSRC interface 22 at step S125.

The roadside unit 30 decrypts the card data of the IC card 40 and the first ID code ID1 of the on-board unit 20 by using a built-in SAM (not shown). The roadside unit 30 generates an ETC data from the card data, the first ID code ID1, and an entrance data based on a predetermined algorithm. The entrance data indicates an entrance tollgate through which the vehicle enters the tollroad. The roadside unit 30 encrypts the ETC data by using the built-in SAM and transmits the ETC data to the on-board unit 20 at step S130. The control circuit 27 of the on-board unit 20 decrypts the ETC data received from the roadside unit 30 by using the SAM 24 and causes the memory device 26 to store the ETC data at step S135.

At an unmanned exit tollgate where the roadside unit 30 is installed, the vehicle exits the tollroad according to the following procedure. The control circuit 27 of the on-board unit 20 reads the ETC data from the memory device 26 in response to a request from the roadside unit 30. Then, the control circuit 27 encrypts the ETC data by using the SAM 24 and transmits the ETC data to the roadside unit 30. Thus, a toll collection transaction is automatically executed based on the ETC data in a known manner so that the vehicle can exit the tollroad without stopping at the unmanned exit tollgate.

Figure 5:
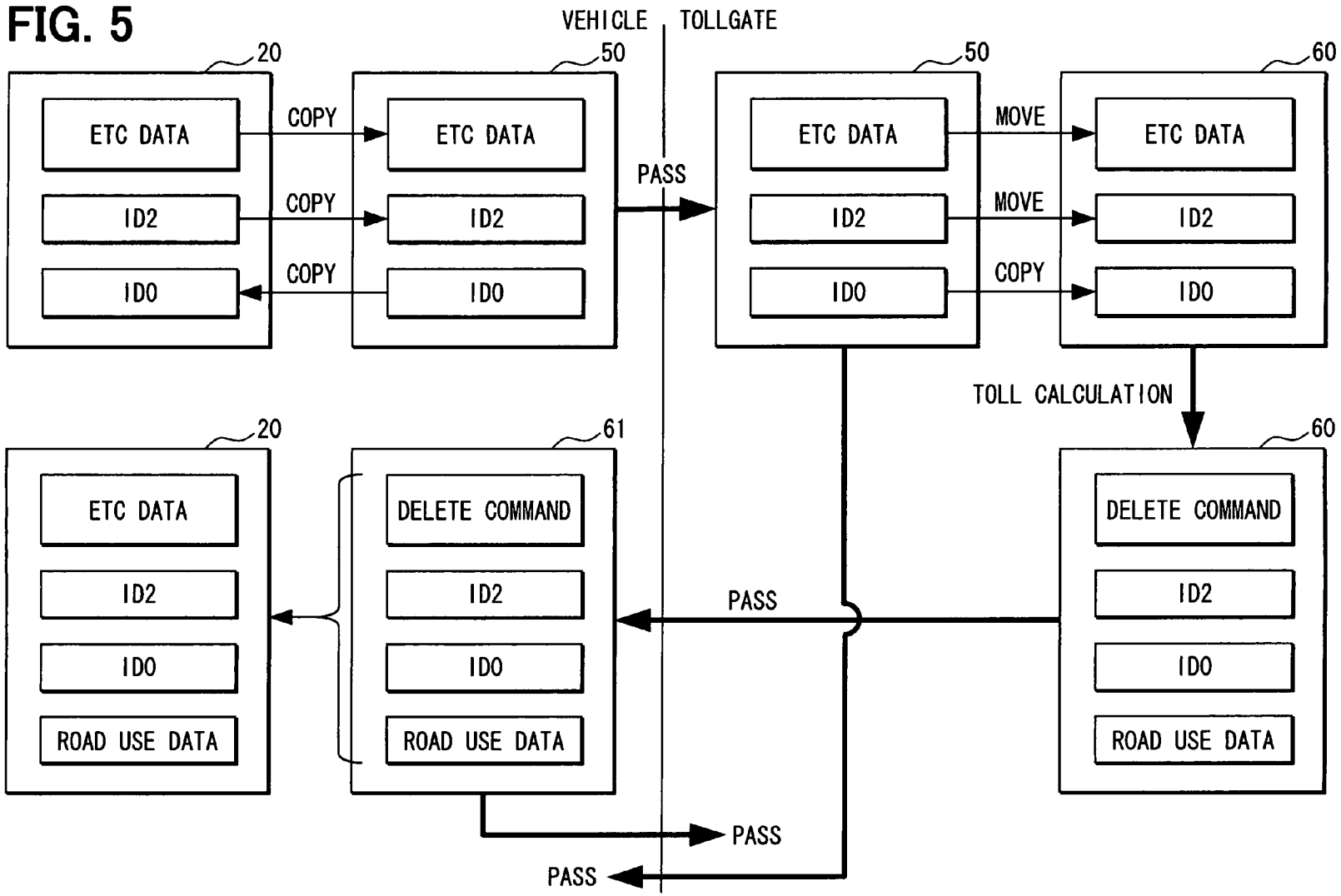
FIG. 5 is a diagram illustrating a procedure performed at a manned exit tollgate.

In contrast, at a manned exit tollgate, the vehicle exits the tollroad according to a procedure shown in FIG. 5. First, in the vehicle, the ETC data and a second unique ID code ID2 of the on-board unit 20 are copied from the on-board unit 20 to the cellular phone unit 50, and an unique ID code ID0 of the cellular phone unit 50 is copied from the cellular phone unit 50 to the on-board unit 20. The second ID code ID2 is prestored in the memory device 26 of the on-board unit 20, and the ID code ID0 is prestored in the memory device 55 of the cellular phone unit 50. In this case, the ETC data and the second ID code ID2 are copied after being encrypted by the SAM 24. Thus, the ETC data and the second ID code ID2 can be prevented from being falsified. As mentioned previously, the ETC data includes the entrance data, the card data of the IC card 40, and the first ID code ID1 of the on-board unit 20. Therefore, the on-board unit 20 has two ID codes ID1, ID2. The first and second ID codes ID1, ID2 are used for different purposes as described later.

The user in the vehicle passes the cellular phone unit 50 to a tollgate attendant at the manned exit tollgate of the tollroad. The ETC data, the second ID code ID2 of the on-board unit 20, and the ID code ID0 of the cellular phone unit 50 are copied from the cellular phone unit 50 to the toll collection unit 60 installed at the manned exit tollgate. The toll collection unit 60 calculates a toll fee for the tollroad the vehicle travels. Then, the toll attendant passes the portable terminal unit 61 of the toll collection unit 60 to the user.

When the user receives the portable terminal unit 61, the portable terminal unit 61 transmits a delete command, the second ID code ID2, and the ID code ID0 to the on-board unit 20. The on-board unit 20 determines whether the second ID code ID2 presently received from the portable terminal unit 61 matches the second ID code ID2 prestored in the on-board unit 20, and determines whether the ID code ID0 presently received from the portable terminal unit 61 matches the ID code ID0 stored in the on-board unit 20. If the second ID code ID2 received from the portable terminal unit 61 matches the second ID code ID2 prestored in the on-board unit 20, and the ID code ID0 received from the portable terminal unit 61 matches the ID code ID0 stored in the on-board unit 20, the ETC data and the ID code ID0 are deleted from the on-board unit 20.

The above-described procedure performed when the vehicle exits the tollroad at the manned exit tollgate is described in detail below.

Figure 6:
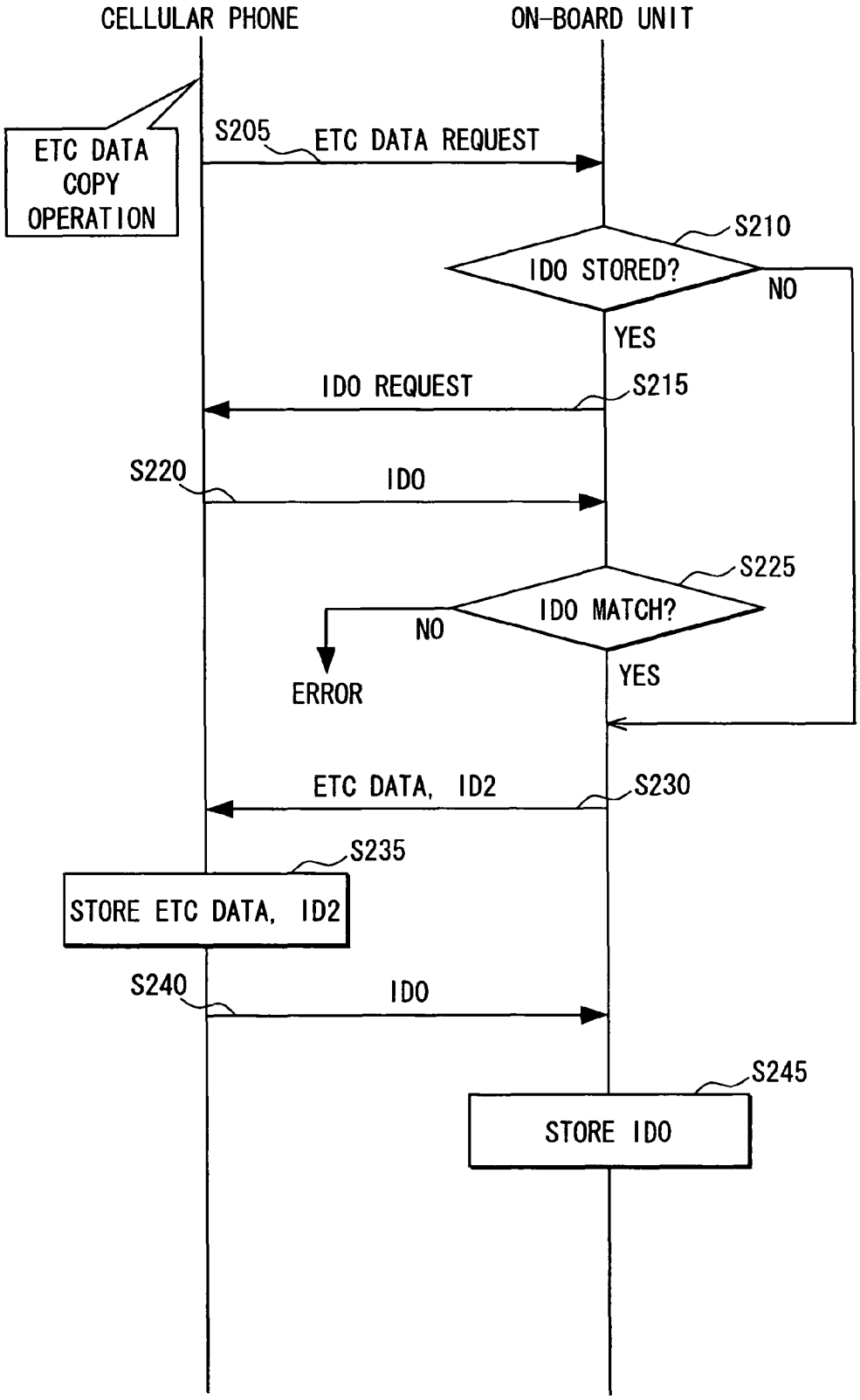
FIG. 6 is a sequence diagram illustrating a procedure performed between the on-board unit and the cellular phone unit.

First, a first procedure performed between the on-board unit 20 and the cellular phone unit 50 is described below with reference to FIG. 6. When the user operates the HMI 53 (e.g., a button assigned to a ETC data copy) of the cellular phone unit 50 to copy the ETC data stored in the on-board unit 20 to the cellular phone unit 50, the control circuit 56 of the cellular phone unit 50 sends a ETC data request to the on-board unit 20 through the contactless communication interface 54 at step S205. In response to the ETC data request from the cellular phone unit 50, the control circuit 27 of the on-board unit 20 determines whether the ID code ID0 of the cellular phone unit 50 has been stored in the memory device 26 at step S210. The ID code ID0 may be, for example, a cellular phone serial code, a cellular phone telephone code, and/or the like. If the ID code ID0 has been already stored in the memory device 26 corresponding to YES at step S210, the procedure proceeds to step S215. In contrast, if the ID code ID0 has not been stored in the memory device 26 yet corresponding to NO at step S210, the procedure jumps to step S230 by skipping steps S215, S220, and S225.

At step S215, the control circuit 27 of the on-board unit 20 sends an ID0 request to the cellular phone unit 50. In response to the ID0 request from the on-board unit 20, the control circuit 56 transmits the ID code ID0 prestored in the memory device 55 to the on-board unit 20 at step S220. Alternatively, the control circuit 56 may generate a unique ID code and may use the generated ID code instead of the prestored ID code ID0.

At step S225, the control circuit 27 of the on-board unit 20 determines whether the ID code ID0 stored in the memory device 26 matches the ID code ID0 presently received from the cellular phone unit 50. If the ID code ID0 stored in the memory device 26 matches the ID code ID0 presently received from the cellular phone unit 50 corresponding to YES at step S225, the procedure proceeds to step S230. In contrast, if the ID code ID0 stored in the memory device 26 does not match the ID code ID0 presently received from the cellular phone unit 50 corresponding to NO at step S225, the procedure is terminated after reporting an error to the user through the HMI 53 (e.g., a speaker and/or a LCD screen).

At step S230, the control circuit 27 of the on-board unit 20 transmits the ETC data and the second ID code ID2 of the on-board unit 20 stored in the memory device 26 to the cellular phone unit 50. In this case, the ETC data and the second ID code ID2 are transmitted to the cellular phone unit 50 after being encrypted by the SAM 24.

At step S235, the control circuit 56 of the cellular phone unit 50 causes the memory device 55 to store the ETC data and the second ID code ID2 received from the on-board unit 20. At step S240, the control circuit 56 transmits the ID code ID0 prestored in the memory device 55 to the on-board unit 20. If the ID code ID0 has been transmitted from the cellular phone unit 50 to the on-board unit 20 at step S220, step S240 can be skipped. At step S245, the control circuit 27 of the on-board unit 20 causes the memory device 26 to store the ID code ID0 received from the cellular phone unit 50.

Figure 7:
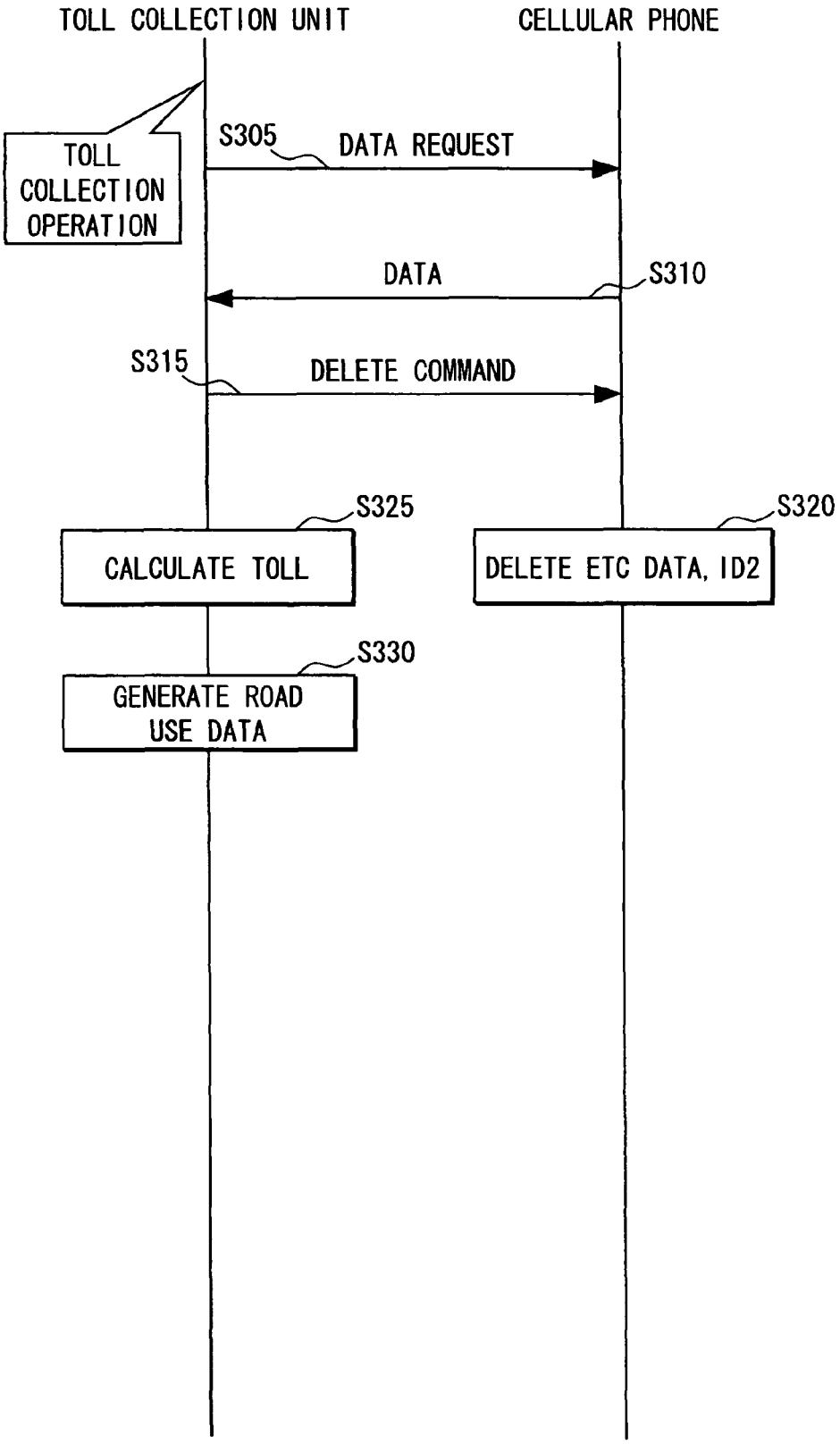
FIG. 7 is a sequence diagram illustrating a procedure performed between the cellular phone unit and the toll collection unit.

Next, a second procedure performed between the cellular phone unit 50 and the toll collection unit 60 is described below with reference to FIG. 7. The second procedure is performed after the user passes the cellular phone unit 50, which stores the ETC data and the second ID code ID2 of the on-board unit 20, to the toll attendant at the exit tollgate of the tollroad.

When the toll attendant operates the HMI 62 (e.g., a button assigned to a toll collection) of the portable terminal unit 61 of the toll collection unit 60 to move the ETC data and the second ID code ID2 of the on-board unit 20 from the cellular phone unit 50 to the toll collection unit 60, the control circuit 66 of the portable terminal unit 61 sends a data request to the cellular phone unit 50 through the contactless communication interface 64 at step S305. In response to the data request from the portable terminal unit 61, the control circuit 56 of the cellular phone unit 50 reads the ETC data, the second ID code ID2 of the on-board unit 20, and the ID code ID0 of the cellular phone unit 50 from the memory device 55 and transmits the read data (i.e., the ETC data, the second ID code ID2, and the ID code ID0) to the toll collection unit 60 at step S310. When receiving the ETC data, the second ID code ID2, and the ID code ID0 from the cellular phone unit 50, the control circuit 66 of the portable terminal unit 61 of the toll collection unit 60 transmits a delete command to the cellular phone unit 50 at step S 315.

In response to the delete command from the toll collection unit 60, the control circuit 56 of the cellular phone unit 50 deletes the ETC data and the second ID code ID2 of the on-board unit 20 from the memory device 55 at step S320. The control circuit 66 of the portable terminal unit 61 of the toll collection unit 60 decrypts the ETC data and then extracts the card data of the IC card 41, the first ID code ID1 of the on-board unit 20, and the entrance data from the ETC data based on a predetermined algorithm.

At step S325, based on the card data, the first ID code ID1, and the entrance data, the control circuit 66 of the portable terminal unit 61 calculates a toll fee for the tollroad the vehicle travels. At step S330, the control circuit 66 generates road use data and causes the memory device 63 of the portable terminal unit 61 to store the road use data. For example, the road use data includes the toll fee for the tollroad, a date of use of the tollroad, and/or the like.

Figure 8:
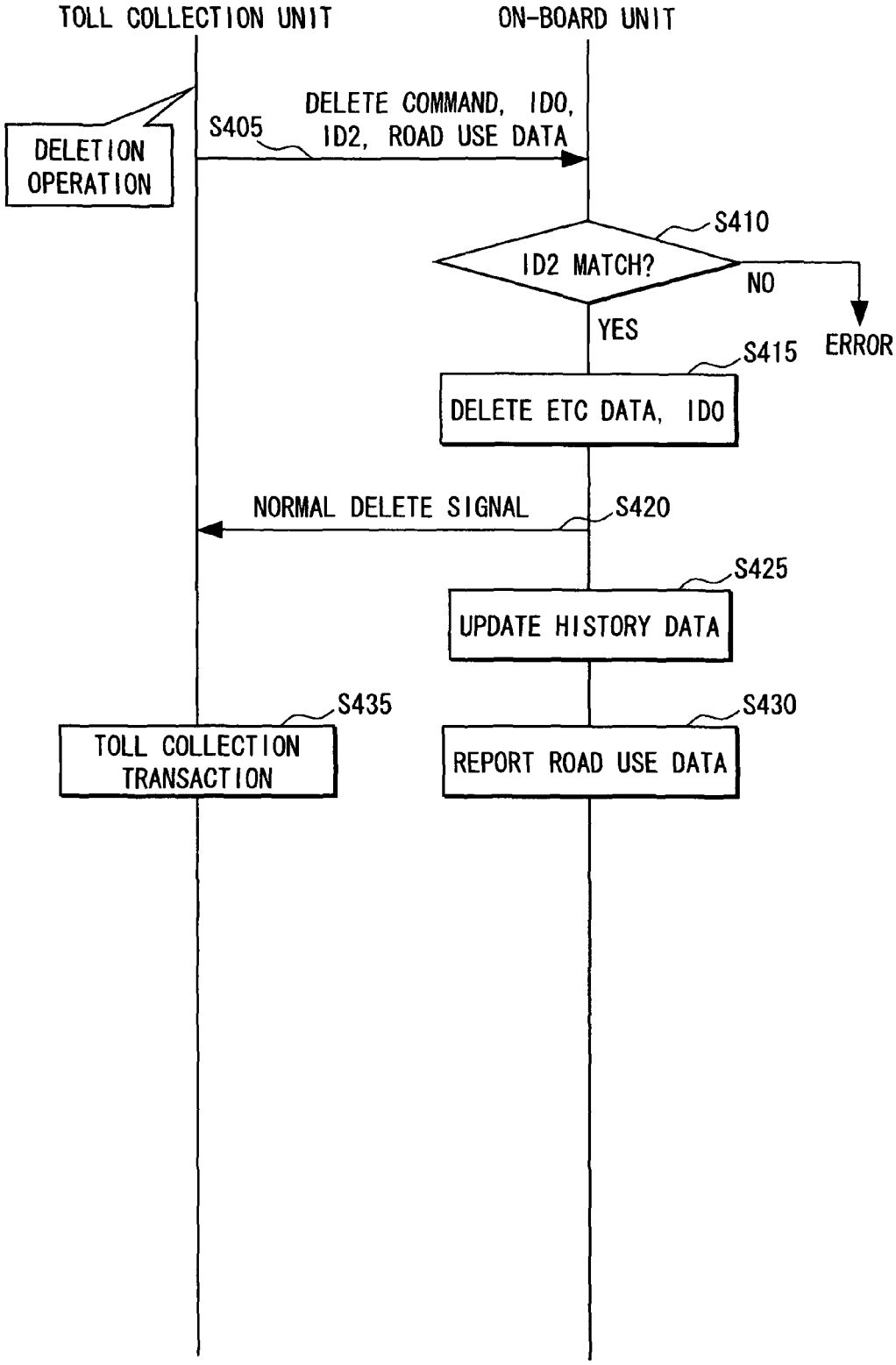
FIG. 8 is a sequence diagram illustrating a procedure performed between the toll collection unit and the on-board unit.

Finally, a third procedure performed between the toll collection unit 60 and the on-board unit 20 is described below with reference to FIG. 8. The third procedure is performed after the tollgate attendant at the exit tollgate passes the portable terminal unit 61 storing the road use data to the user in the vehicle. When the user operates the HMI 62 (e.g., a button assigned to a data deletion) of the portable terminal unit 61 of the toll collection unit 60 to delete the ETC data and the ID code ID0 of the cellular phone unit 50 stored in the on-board unit 20, the control circuit 66 of the portable terminal unit 61 transmits a delete command, the second ID code ID2, the ID code ID0, and the road use data to the on-board unit 20 through the contactless communication interface 64 at step S405.

Then, at step S410, the control circuit 27 of the on-board unit 20 determines whether the second ID code ID2 prestored in the memory device 26 matches the second ID code ID2 received from the portable terminal unit 61. If the second ID code ID2 stored in the memory device 26 matches the second ID code ID2 presently received from the portable terminal unit 61 corresponding to YES at step S410, the procedure proceeds to step S415. In contrast, if the second ID code ID2 prestored in the memory device 26 does not match the second ID code ID2 presently received from the portable terminal unit 61 corresponding to NO at step S410, the procedure is terminated after reporting an error to the user through the HMI 23 (e.g., a speaker and/or an indicator lamp).

At step S415, the control circuit 27 of the on-board unit 20 deletes the ETC data and the ID code ID0 of the cellular phone unit 50 from the memory device 26. Then, at step 420, the control circuit 27 sends a normal delete signal to the portable terminal unit 61 through the contactless communication interface 25. The normal delete signal indicates that the ETC data and the ID code ID0 have been normally deleted from the memory device 26. At step S425, the control circuit 27 updates usage history data by using the road use data, which is received from the portable terminal unit 61 at step S405. Thus, the usage history data consists of the past road use data. At step 430, the control circuit 27 reports the road use data to the user by voice through the HMI 23 (e.g., a speaker). The user can get any desired road use data from the usage history data by operating the HMI 23 (e.g., a button assigned to road use information).

In the toll collection unit 60, in response to the normal delete signal from the on-board unit 20, the control circuit 66 of the portable terminal unit 61 transmits a toll collection command, the card data of the IC card 40, the second ID code ID2 of the on-board unit 20, the toll fee, the entrance data, and exit data to the main unit 71 through the wireless LAN interface 65. At step S435, in response to the toll collection command, the control circuit 76 of the main unit 71 of the toll collection unit 60 performs a toll collection transaction by transmitting the card data, the second ID code ID2, the calculated toll, the entrance data, and the exit data to the toll payment server (not shown) through the WAN interface 75.

As described above, according to the ETC system 10, even when any user in the vehicle does not carry the IC card 40, the vehicle can pass through the manned exit tollgate of the tollroad. Since a communication cable is not used, the toll collection transaction at the manned exit tollgate is completed in a short time so that traffic congestion can be prevented.

Further, the ETC system 10 provides the following fraud prevention measures.

(First Fraud Prevention Measure)

When the ETC data and the second ID code ID2 of the on-board unit 20 are transmitted from the cellular phone unit 50 to the toll collection unit 60 (at S310), the ETC data and the second ID code ID2 are deleted from the memory device 55 of the cellular phone unit 50 (at S320). This approach prevents the ETC data used once at the manned exit tollgate from being used again at the same manned exit tollgate or another manned exit tollgate.

(Second Fraud Prevention Measure)

When the on-board unit 20 receives the request for the ETC data from the cellular phone unit 50 again after transmitting the ETC data to the cellular phone unit 50 one or more times, the on-board unit 20 requests the ID code ID0 from the cellular phone unit 50 (at step S215). The on-board unit 20 determines whether the previously received, stored ID code ID0 matches the presently received ID code ID0 (at step S225). The on-board unit 20 transmits the ETC data to the cellular phone unit 50 again only when the previously received, stored ID code ID0 matches the presently received ID code ID0 (at step S230). This approach prevents the ETC data stored in the on-board unit 20 from being copied to multiple cellular phone units 50. Thus, the ETC data can be prevented from being used for toll collection transactions for other vehicles.

(Third Fraud Prevention Measure)

The on-board unit 20 transmits its own ID code ID2 prestored therein together with the ETC data to the cellular phone unit 50 (at step S230), the cellular phone unit 50 then transmits the ID code ID2 of the on-board unit 20 together with the ETC data to the toll collection unit 60 (at step S310), and the toll collection unit 60 then transmits the ID code ID2 of the on-board unit 20 together with the road use data to the on-board unit 20 (at step S405). Then, the on-board unit 20 deletes the ETC data from the memory device 26, only when the prestored ID code ID2 matches the ID code ID2 presently received from the toll collection unit 60 (at step S410, S415). In such an approach, when the user passes the cellular phone unit 50 storing the ETC data copied from other vehicles to the tollgate attendant at the exit tollgate, the toll collection unit 60 cannot delete the ETC data stored in the on-board unit 20. Thus, even if the cellular phone unit 50 is intentionally exchanged with another cellular phone, for example, at a service area on the tollroad, fraud can be prevented.

Correspondence of words between the embodiment and claim are described below. The wireless antenna 21 and the DSRC interface 22 correspond to "a vehicle-side first communication circuit". The contactless communication interface 25 corresponds to "a vehicle-side second communication circuit" and "a vehicle-side third communication circuit". The memory device 26 corresponds to "a vehicle-side memory device". The control circuit 27 corresponds to "a vehicle-side control circuit". The cellular phone unit 50 corresponds to "a first terminal unit". The contactless communication interface 54 corresponds to "a first terminal-side first communication circuit" and "a first terminal-side second communication circuit". The memory device 55 corresponds to "a first terminal-side memory device". The control circuit 56 corresponds to "a first terminal-side control circuit". The toll collection unit 60 corresponds to "a second terminal unit". The contactless communication interface 64 corresponds to "a second terminal-side first communication circuit" and "a second terminal-side second communication circuit". The memory device 63 corresponds to "a second terminal-side memory device". The control circuit 66 corresponds to "a second terminal-side control circuit".

(Modifications)

The embodiment described above may be modified in various ways. For example, the IC card 40 can be other types of payment cards such as magnetic stripe cards. The control circuit 56 of the cellular phone unit 50 can automatically delete the ETC data and the second ID code ID2 of the on-board unit 20 from the memory device 55, when a predetermined time period (e.g., about ten to twenty minutes) has elapsed since the ETC data and the second ID code ID2 were copied from the on-board unit 20 to the cellular phone unit 50. In such an approach, even if the cellular phone unit 50 is used by other users, the ETC data and the second ID code ID2 can be prevented from being used for fraud.

In the embodiment, the on-board unit 20 communicates with the cellular phone unit 50 and the toll collection unit 60 through the same interface 25. Alternatively, the on-board unit 20 can communicate with the cellular phone unit 50 and the toll collection unit 60 through different interfaces. In the embodiment, the cellular phone unit 50 communicates with the on-board unit 20 and the toll collection unit 60 through the same interface 54. Alternatively, the cellular phone unit 50 can communicate with the on-board unit 20 and the toll collection unit 60 through different interfaces. In the embodiment, the toll collection unit 60 communicates with the on-board unit 20 and the cellular phone unit 50 through the same interface 64. Alternatively, the toll collection unit 60 can communicate with the on-board unit 20 and the cellular phone unit 50 through different interfaces.

Figure 9:
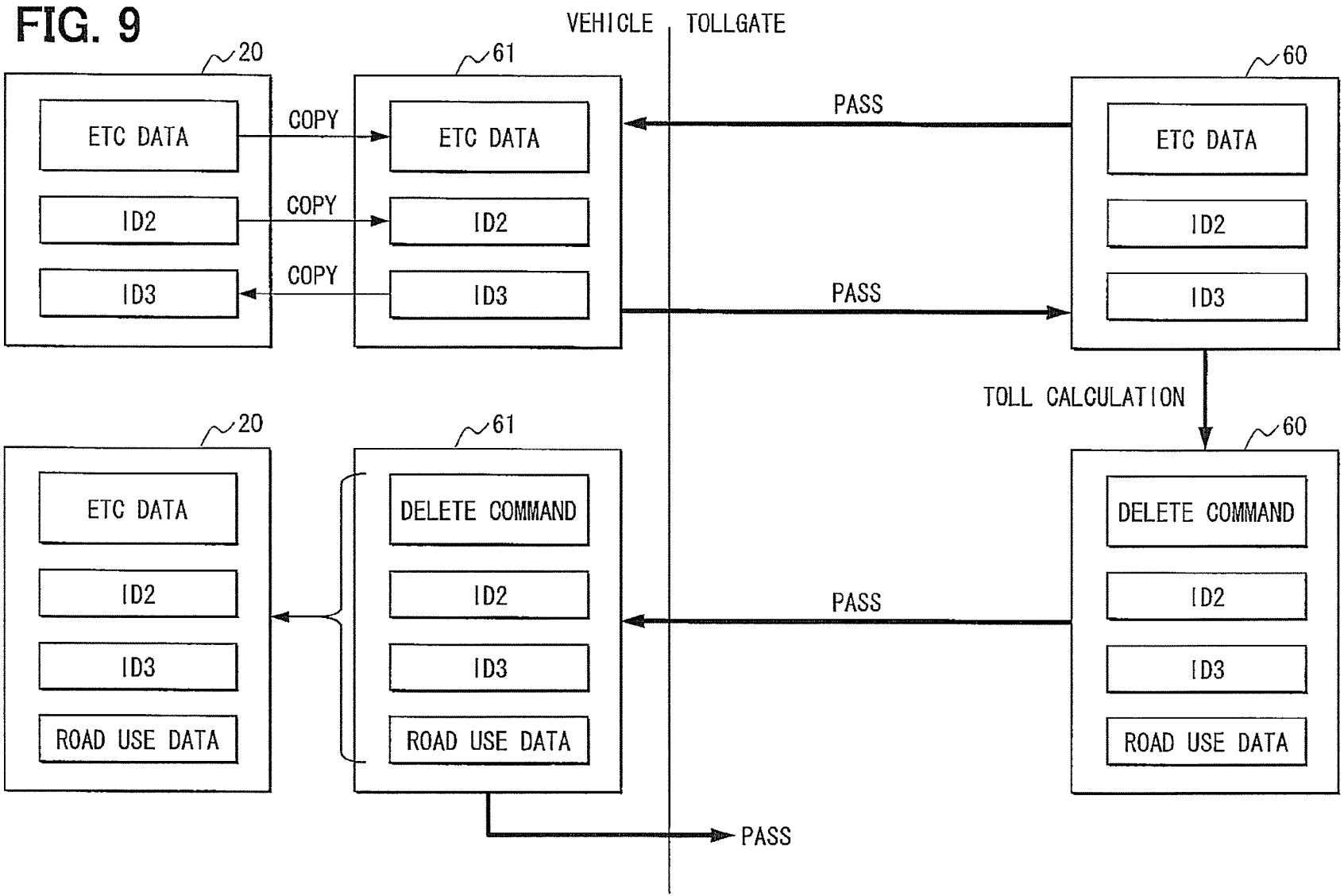
FIG. 9 is a diagram illustrating a procedure, according to a modification of the embodiment, performed without the cellular phone unit at the manned exit tollgate.

Data transmission between the on-board unit 20 and the toll collection unit 60 can be achieved without the cellular phone unit 50. FIG. 9 shows one procedure to achieve the data transmission without the cellular phone unit 50. The exit tollgate attendant passes the portable terminal unit 61 of the toll collection unit 60 to the user in the vehicle, the ETC data and the second ID code ID2 of the on-board unit 20 are copied from the on-board unit 20 to the portable terminal unit 61, and an unique ID code ID3 of the toll collection unit 60 is copied from the portable terminal unit 61 to the on-board unit 20.

Then, the user in the vehicle passes the portable terminal unit 61 of the toll collection unit 60 back to the tollgate attendant, and the tollgate attendant operates the portable terminal unit 61 to calculate a toll fee. The portable terminal unit 61 calculates the toll fee based on the ETC data and generates a delete command and road use data.

Then, the tollgate attendant passes the portable terminal unit 61 to the user again. The user brings the portable terminal unit 61 close to the on-board unit 20, so that data transmission between the on-board unit 20 and the toll collection unit 60 can be achieved in the same manner as data transmission between the on-board unit 20 and the cellular phone unit 50. Therefore, the ETC system 10 can be used, even when any user in the vehicle does not have the cellular phone unit 50.

Figure 10:
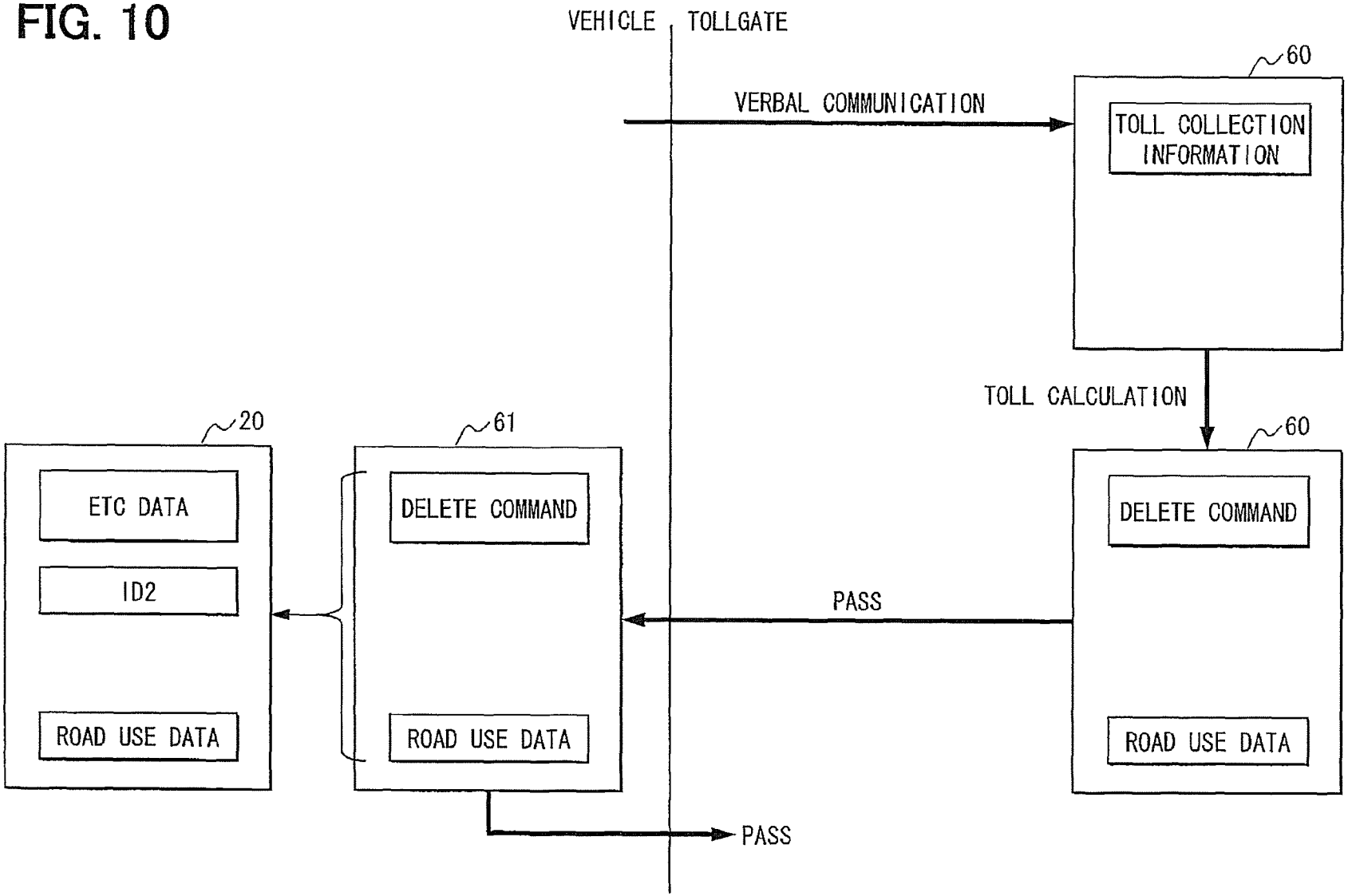
FIG. 10 is a diagram illustrating a procedure, according to another modification of the embodiment, performed without the cellular phone unit at the manned exit tollgate.

FIG. 10 shows another procedure to achieve the data transmission between the on-board unit 20 and the toll collection unit 60 without the cellular phone unit 50. In the case of FIG. 10, the user in the vehicle verbally communicates with the tollgate attendant to give toll collection information necessary for a toll collection transaction. For example, the toll collection information includes a name of an entrance tollgate through which the vehicle entered the tollroad, the card data of the IC card 40, and/or the like. The tollgate attendant inputs the toll collection information to the toll collection unit 60. The toll collection unit 60 calculates a toll fee based on the toll payment information and generates a delete command and road use data. Then, the tollgate attendant passes the portable terminal unit 61 of the toll collection unit 60 to the user. The user brings the portable terminal unit 61 close to the on-board unit 20, so that data transmission between the on-board unit 20 and the toll collection unit 60 can be achieved in the same manner as data transmission between the on-board unit 20 and the cellular phone unit 50. Therefore, the ETC system 10 can be used, even when any user in the vehicle does not have the cellular phone unit 50.

Such changes and modifications are to be understood as being within the scope of the present invention as defined by the appended claims.

What is claimed is:

1. An electronic toll collection system comprising an on-board unit mountable on a vehicle, a first terminal unit, and a second terminal unit;

the on-board unit comprising:

a vehicle-side first communication circuit configured to wirelessly communicate with a roadside unit for transmitting entrance data indicative of a tollroad entrance the vehicle passes through;

a vehicle-side second communication circuit configured to communicate with the first terminal unit;

a vehicle-side third communication circuit configured to communicate with the second terminal unit;

a vehicle-side memory device; and a vehicle-side control circuit configured to control the vehicle-side first, second, and third communication circuits and the vehicle-side memory device and configured to perform data processing necessary for a toll collection transaction;

the first terminal unit comprising:

a first terminal-side first communication circuit configured to communicate with the on-board unit;

a first terminal-side second communication circuit configured to communicate with the second terminal unit;

a first terminal-side memory device; and a first terminal-side control circuit configured to control the first terminal-side first and second communication circuits and the first terminal-side memory device;

the second terminal unit comprising:

a second terminal-side first communication circuit configured to communicate with the on-board unit;

a second terminal-side second communication circuit configured to communicate with the first terminal unit;

a second terminal-side memory device; and a second terminal-side control circuit configured to control the second terminal-side first and second communication circuits and the second terminal-side memory device;

wherein the vehicle-side control circuit receives the entrance data from the roadside unit through the vehicle-side first communication circuit and causes the vehicle-side memory device to store the entrance data, the vehicle-side control circuit transmitting the entrance data and payment card data prestored in the vehicle-side memory device to the first terminal unit through the vehicle-side second communication circuit upon satisfaction of a first predetermined condition, wherein the first terminal-side control circuit receives the entrance data and the card data from the on-board unit through the first terminal-side first communication circuit and causes the first terminal-side memory device to store the entrance data and the card data, the first terminal-side control circuit transmitting the entrance data and the card data to the second terminal unit through the first terminal-side second communication circuit in response to a data request that is received from the second terminal unit through the first terminal-side second communication circuit, wherein the second terminal-side control circuit receives the entrance data and the card data from the first terminal unit through the second terminal-side second communication circuit upon transmission of the data request to the first terminal unit and generates toll collection data based on the entrance data and the card data, the second terminal-side control circuit transmitting the toll collection data to the on-board unit through the second terminal-side first communication circuit upon satisfaction of a second predetermined condition, wherein the vehicle-side control circuit deletes the entrance data from the vehicle-side memory device upon receipt of the toll collection data from the second terminal unit through the vehicle-side third communication circuit, and wherein the first terminal-side control circuit deletes the card data and the entrance data from the first terminal-side memory device upon transmission of the card data and the entrance data to the second terminal unit.

2. The system according to claim 1, wherein the first terminal-side control circuit deletes the card data and the entrance data from the first terminal-side memory device upon a lapse of a predetermined time period since the card data and the entrance data are stored in the first terminal-side memory device.

3. The system according to claim 1, wherein the vehicle-side control circuit receives an unique identification code of the first terminal unit from the first terminal unit through the vehicle-side second communication circuit upon the transmission of the card data and the entrance data to the first terminal unit and causes the unique identification code to store the vehicle-side memory device, and wherein the vehicle-side control circuit is allowed to transmit the card data and the entrance data to only the first terminal unit having the unique identification code stored in the vehicle-side memory device until the entrance data is deleted from the vehicle-side memory device.

4. The system according to claim 1, wherein the vehicle-side control circuit transmits an unique identification code of the on-board unit in addition to the card data and the entrance data to the first terminal unit, the unique identification code of the on-board unit being prestored in the vehicle-side memory device, wherein the first terminal-side control circuit receives the unique identification code of the on-board unit from the on-board unit through the first terminal-side first communication circuit and causes the first terminal-side memory device to store the unique identification code of the on-board unit in addition to the card data and the entrance data, wherein the first terminal-side control circuit transmits the unique identification code of the on-board unit in addition to the entrance data and the card data to the second terminal unit in response to the data request from the second terminal unit, wherein the second terminal-side control circuit receives the unique identification code of the on-board unit from the first terminal unit through the second terminal-side second communication circuit and transmits the unique identification code of the on-board unit together with the toll collection data to the on-board unit, and wherein the vehicle-side control circuit receives the unique identification code of the on-board unit back from the second terminal unit through the vehicle-side third communication circuit and deletes the entrance data from the vehicle-side memory device only upon a match between the received unique identification code of the on-board unit and the unique identification code prestored in the vehicle-side memory device.

5. The system according to claim 1, wherein the first terminal unit has a telephone function and serves as a cellular phone.

6. An on-board unit for an electronic toll collection system comprising:

a first communication circuit configured to wirelessly communicate with a roadside unit;

a second communication circuit configured to communicate with a first terminal unit;

a third communication circuit configured to communicate with a second terminal unit;

a memory device; and a control circuit configured to control the first, second, and third communication circuits and the memory device and configured to perform data processing necessary for a toll collection transaction, wherein the control circuit receives entrance data from the roadside unit through the first communication circuit and causes the memory device to store the entrance data, the control circuit transmitting the entrance data and card data prestored in the memory device to the first terminal unit through the second communication circuit upon satisfaction of a predetermined condition, wherein the control circuit deletes the entrance data from the memory device upon receipt of toll collection data from the second terminal unit through the third communication circuit, wherein the control circuit receives an unique identification code of the first terminal unit from the first terminal unit through the second communication circuit upon the transmission of the card data and the entrance data to the first terminal unit and causes the unique identification code of the first terminal unit to store the memory device, and wherein the vehicle-side control circuit is allowed to transmit the card data and the entrance data to only the first terminal unit having the unique identification code stored in the memory device until the entrance data is deleted from the memory device.

7. The on-board unit according to claim 6, wherein the control circuit transmits an unique identification code of the on-board unit in addition to the card data and the entrance data to the first terminal unit, the unique identification code of the on-board unit being prestored in the memory device, and wherein the control circuit receives the unique identification code of the on-board unit back from the second terminal unit through the third communication circuit and deletes the entrance data from the memory device only upon a match between the received unique identification code of the on-board unit and the unique identification code prestored in the memory device.

8. The system according to claim 1, wherein the second terminal unit sends a delete command to the first terminal unit to delete the card data after receipt of the card data by the second terminal unit.

9. The on-board unit according to claim 6, wherein the second terminal sends a delete command to the on-board unit to delete the entrance data from the memory device upon receipt of the toll collection data.

* * * * *